US010688678B2

(12) United States Patent
Clément et al.

(10) Patent No.: US 10,688,678 B2
(45) Date of Patent: Jun. 23, 2020

(54) METHOD AND STATION FOR CONVERTING A FLAT SUBSTRATE

(71) Applicant: BOBST MEX SA, Mex (CH)

(72) Inventors: Philippe Clément, Penthalaz (CH); Pierre Robadey, St Sulpice (CH)

(73) Assignee: BOBST MEX SA (CH)

( * ) Notice: Subject to any disclaimer, the term of this patent is extended or adjusted under 35 U.S.C. 154(b) by 282 days.

(21) Appl. No.: 15/532,125

(22) PCT Filed: Dec. 3, 2015

(86) PCT No.: PCT/EP2015/025095
§ 371 (c)(1),
(2) Date: Jun. 1, 2017

(87) PCT Pub. No.: WO2016/087053
PCT Pub. Date: Jun. 9, 2016

(65) Prior Publication Data

US 2017/0266832 A1 Sep. 21, 2017

(30) Foreign Application Priority Data

Dec. 4, 2014 (EP) ..... 14020106

(51) Int. Cl.
*B26D 7/26* (2006.01)
*B26F 1/38* (2006.01)
(Continued)

(52) U.S. Cl.
CPC ..... *B26D 7/265* (2013.01); *B26F 1/384* (2013.01); *B26F 1/44* (2013.01); *B31B 50/25* (2017.08);
(Continued)

(58) Field of Classification Search
CPC ..... B31B 50/14; B31B 50/16; B31B 50/20; B31B 50/256; B31B 70/14; B31B 70/20; B31B 70/88; B29C 43/46
(Continued)

(56) References Cited

U.S. PATENT DOCUMENTS 3,731,620 A * 5/1973 Klemmer ..... B30B 3/04 101/23
4,608,895 A * 9/1986 Bell ..... B23P 15/406 493/370
(Continued)

FOREIGN PATENT DOCUMENTS

EP 0 737 554 A2 10/1996
WO WO 2006/061869 A1 6/2006
(Continued)

OTHER PUBLICATIONS

International Search Report dated Feb. 24, 2016 in corresponding PCT International Application No. PCT/EP2015/025095.
(Continued)

*Primary Examiner* — Hemant Desai
*Assistant Examiner* — Jacob A Smith
(74) *Attorney, Agent, or Firm* — Ostrolenk Faber LLP

(57) ABSTRACT

A method for converting a flat substrate (W) in a station (3) for converting a flat substrate (W) that includes a rotary cutting unit (9) and at least one rotary deformation unit (7, 8) positioned upstream of the rotary cutting unit (9) in the direction of movement (L) of the flat substrate (W), the method including: determining the conversion parameters of the flat substrate (W), such as the deformation layout and cutting layout; choosing a sleeve (13) carrying a form for carrying out the deformation depending on the deformation layout; mounting the sleeve (13) on a mandrel (12) in the rotary deformation unit (7, 8); choosing the cutting tools (91,
(Continued)

92) depending on the cutting layout; mounting the cutting tools (91, 92) in the rotary cutting unit (9); and starting the conversion of the flat substrate (W).

9 Claims, 2 Drawing Sheets

(51) Int. Cl.

| | |
|---|---|
| ***B26F 1/44*** | (2006.01) |
| ***B31F 1/07*** | (2006.01) |
| ***B31F 1/00*** | (2006.01) |
| ***B31B 50/25*** | (2017.01) |
| *B26D 7/20* | (2006.01) |
| *B31B 50/14* | (2017.01) |
| *B31B 50/88* | (2017.01) |
| *B31B 100/00* | (2017.01) |
| *B31B 120/30* | (2017.01) |

(52) U.S. Cl.
CPC ..... *B31B 50/256* (2017.08); *B31F 1/00* (2013.01); *B31F 1/07* (2013.01); *B26D 7/20* (2013.01); *B26D 2007/2607* (2013.01); *B26F 2001/4418* (2013.01); *B31B 50/14* (2017.08); *B31B 50/146* (2017.08); *B31B 50/88* (2017.08); *B31B 2100/00* (2017.08); *B31B 2120/30* (2017.08); *B31F 2201/0753* (2013.01); *B31F 2201/0776* (2013.01)

(58) Field of Classification Search
USPC ..... 493/58, 59, 60, 340, 353, 354, 355, 361, 493/365, 373, 223
See application file for complete search history.

(56) References Cited

U.S. PATENT DOCUMENTS

| | | | | |
|---|---|---|---|---|
| 4,934,231 | A * | 6/1990 | Chesnut | B23K 9/007 83/343 |
| 5,138,923 | A * | 8/1992 | Kent | B26D 7/2614 403/358 |
| 2009/0298660 | A1* | 12/2009 | Schaack | B31F 1/10 493/340 |
| 2012/0053039 | A1* | 3/2012 | Compagnone | B21B 31/103 493/373 |
| 2012/0276341 | A1* | 11/2012 | Lake | B29C 55/18 428/174 |
| 2013/0319195 | A1* | 12/2013 | Talken | B26D 7/18 83/27 |
| 2014/0100101 | A1* | 4/2014 | Babcock | B41F 19/008 493/478 |

FOREIGN PATENT DOCUMENTS

| | | | | |
|---|---|---|---|---|
| WO | WO 2012/065689 | A1 | 5/2012 | |
| WO | WO-2012065689 | A1 * | 5/2012 | B26D 7/1836 |
| WO | WO 2014/135265 | A1 | 9/2014 | |
| WO | WO-2014135265 | A1 * | 9/2014 | B26D 7/26 |

OTHER PUBLICATIONS

Written Opinion dated Feb. 24, 2016 in corresponding PCT International Application No. PCT/EP2015/025095.

* cited by examiner

METHOD AND STATION FOR CONVERTING A FLAT SUBSTRATE

CROSS-REFERENCE TO RELATED APPLICATION

The present application is a 35 U.S.C. §§ 371 national phase conversion of PCT/EP2015/025095, filed Dec. 3, 2015, which claims priority of European Patent Application No. 14020106.2, filed Dec. 4, 2014, the contents of all of which are incorporated herein by reference. The PCT International Application was published in the French language.

FIELD OF THE INVENTION

The present invention relates to a method for converting a flat substrate in a conversion station. The invention also relates to a station for converting a flat substrate.

BACKGROUND

A machine for converting a substrate is intended for the production of packaging. In this machine, an initial flat substrate, such as a continuous web of cardboard, is unrolled and printed on by a printing station comprising one or more printer units. The flat substrate is then transferred into an introduction unit and then into an embossing unit, possibly followed by a scoring unit. The flat substrate is then cut in a cutting unit. After ejection of the scrap areas, the preforms obtained are sectioned in order to obtain individual boxes.

The rotary conversion, i.e. embossing, scoring, cutting, scrap-ejection, or printer units each comprise a cylindrical upper conversion tool and a cylindrical lower conversion tool, between which the flat substrate passes in order to be converted. In operation, the rotary conversion tools rotate at the same speed but in opposite directions to one another. The flat substrate passes through the gap situated between the rotary tools, which form a relief by embossing, form a relief by scoring, cut the flat substrate into preforms by rotary cutting, eject the scrap, or print a pattern during printing.

The tools can be mounted in a cassette. The cassette allows the operator to adjust the radial gap outside of the machine. On the other hand, this cassette can weigh several hundred kilos and therefore has to be handled with the aid of handling means.

The cylinder changing operations have been found to be time-consuming and tedious. The operator mechanically disconnects the cylinder in order to remove it from its drive mechanism. Then, the operator extracts the cylinder from the conversion machine and fits the new cylinder in the conversion machine by reconnecting it to its drive. The weight of a cylinder is high, around 50 kg to 2000 kg. In order to extract it, the operator lifts it with the aid of handling means.

On account of its fairly high weight, a cylinder cannot be changed very quickly. Moreover, numerous tool changes may be necessary to obtain a very large number of boxes that are different from one another, in order to deal with the increasingly specific requirements made by the customers of printing, embossing, scoring and cutting small runs. These tools have to be ordered a long time in advance, and this is becoming incompatible with the production changes that are currently required. In addition, tools are relatively expensive to produce and they only become cost-effective with an extremely large output.

SUMMARY OF THE INVENTION

An aim of the present invention is to propose a method for converting a flat substrate. A second objective is to produce a station for converting a flat substrate which at least partially solves the drawbacks of the prior art.

To this end, a subject of the present invention is a method for converting a flat substrate in a station for converting a flat substrate comprising a rotary cutting unit and at least one rotary deformation unit, the rotary deformation unit being positioned upstream of the rotary cutting unit in the direction of movement of the flat substrate.

The method comprises the steps of:

- determining the conversion parameters of the flat substrate, such as the deformation layout and cutting layout;
- choosing a sleeve carrying a form for carrying out the deformation depending on the deformation layout;
- mounting the sleeve on a mandrel in the rotary deformation group so as to form the rotary deformation tool;
- choosing the cutting tools depending on the cutting layout;
- mounting the cutting tools in the rotary cutting unit; and
- starting the conversion of the flat substrate.

The deformation is defined, by way of nonlimiting example, as being any operation of mechanical deformation of the flat substrate by squeezing between a positive form provided with one or more convexities or protuberances, i.e. the male tool, and a negative form, provided with one or more concavities or recesses, i.e. the female tool. The deformation (embossing or scoring) is realized in a rotary manner. The deformation unit is defined as being an embossing unit only, a scoring unit, or a unit that is capable of simultaneously ensuring scoring and embossing.

Any combinations are possible for all of the conversion tools, with an upper tool equipped with a sleeve and/or a lower tool equipped with a sleeve.

Thus, when the changing of the rotary tools of the scoring or embossing units of the conversion machine is desired, the corresponding sleeves may be changed rather than the entire rotary tool. The removable sleeve is a carrier and constitutes the form for carrying out the deformation, embossing and/or scoring. The sleeve is easily fittable on the mandrel and can be removed easily from the mandrel during a change of operation.

Since it is easier to handle the sleeve because of its low weight relative to that of the entire rotary tool, the change of operation can be effected rapidly. The sleeves are inexpensive to manufacture compared with the price of the complete rotary tool. It is thus advantageous to use one and the same mandrel in combination with several sleeves rather than to acquire several entire rotary tools.

According to another aspect of the invention, a station for converting a flat substrate, comprising a rotary cutting unit, also comprises at least one rotary deformation unit, positioned upstream of the rotary cutting unit in the direction of movement of the flat substrate, having two rotary deformation tools, an upper rotary tool cooperating with a lower rotary tool, at least one of the two rotary tools comprising a mandrel and a sleeve carrying a form for carrying out the deformation that is able to be fitted on the mandrel in order to be driven and rotated by the mandrel.

The register between the different conversions and deformations that are carried out on the flat substrate is retained. Thus, for example the embossing is in register with the scoring, and the embossing and scoring are in register with the cutting.

The conversion machine comprising a conversion station with a sleeved rotary scoring and/or embossing unit which is integrated upstream of a rotary cutting unit exhibits great flexibility of use.

BRIEF DESCRIPTION OF THE DRAWINGS

Further advantages and features will become apparent from reading the description of the invention and from the appended figures, which show a nonlimiting exemplary embodiment of the invention and in which.

Figure 2:
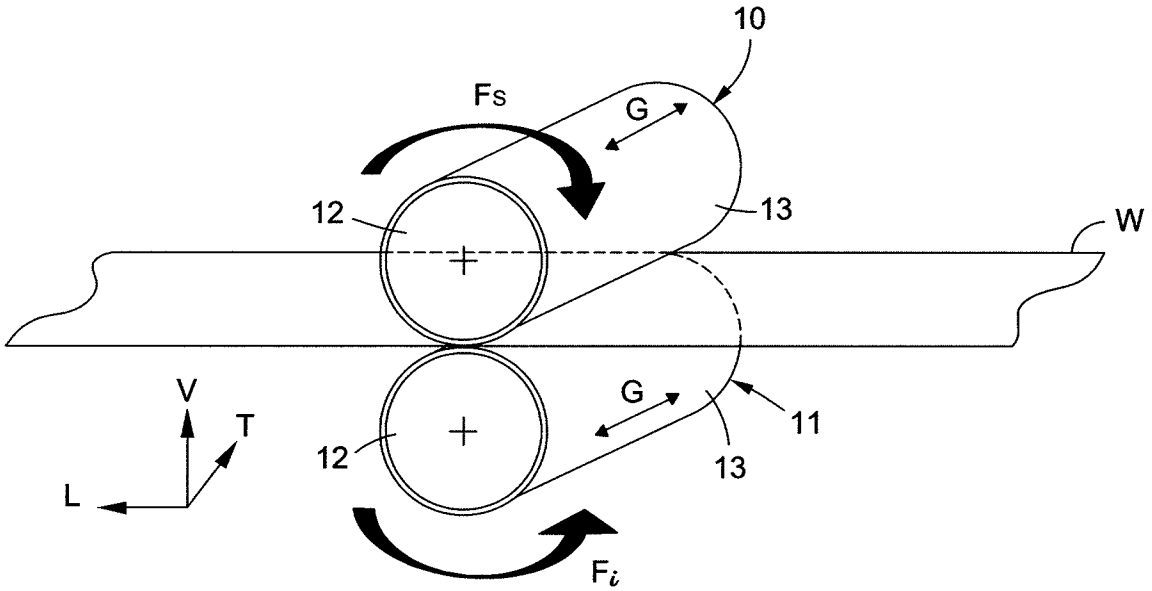
FIG. 2 shows a perspective view of the upper and lower rotary deformation tools.
Figure 3:
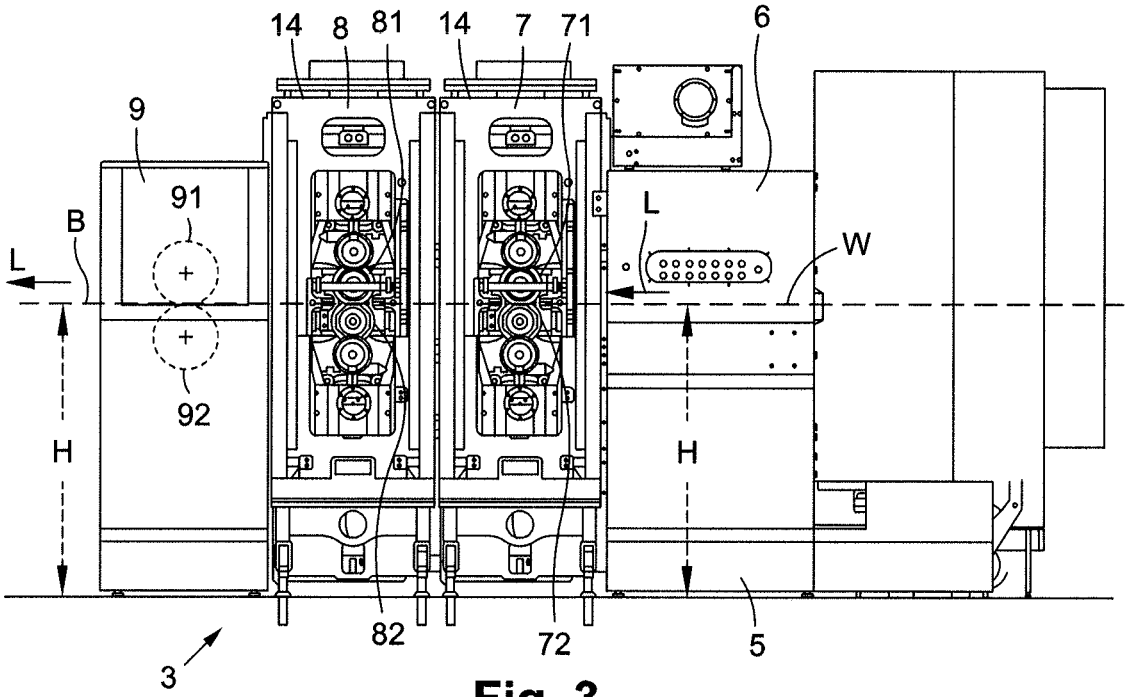
FIG. 3 shows an example of a station for converting a flat substrate.

The longitudinal, vertical and transverse directions indicated in FIGS. 2 and 3 are defined by the trihedron L, V, T. The transverse direction T is the direction perpendicular to the longitudinal direction of movement L of the flat substrate. The horizontal plane corresponds to the plane L, T. The front and rear positions are defined with respect to the transverse direction T as being on the side of the driver and on the opposite side from the driver, respectively.

DETAILED DESCRIPTION OF THE PREFERRED EMBODIMENTS

Figure 1:
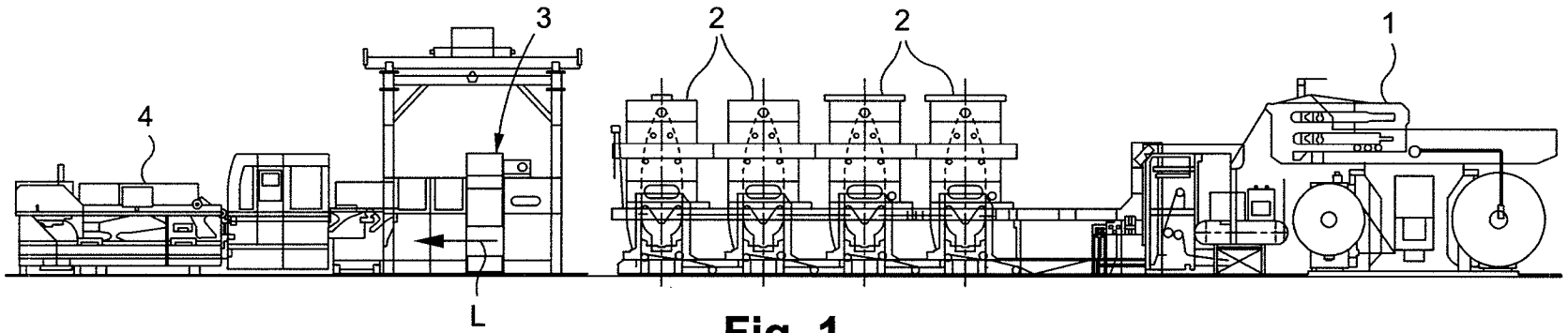
FIG. 1 is an overall view of an example of a conversion line for converting a flat substrate.

A conversion line for converting a flat substrate W, such as flat cardboard or a continuous web of paper wound on a reel, makes it possible to carry out various operations and obtain packaging such as folding boxes. As shown in FIG. 1, the conversion line comprises, disposed one after another in the order of passage L of the flat substrate W, an unwinding station 1, several printer units 2, a station 3 for converting the flat substrate, and a station 4 for receiving the manufactured objects.

The conversion station 3 comprises a framework or load-bearing structure 5 in which an introduction unit 6 comprising a drive roller and turn rollers (not visible), at least one rotary deformation unit, in this case a rotary embossing unit 7 or rotary scoring unit 8, followed by a rotary cutting unit 9 are arranged in the order given.

Figure 4A:
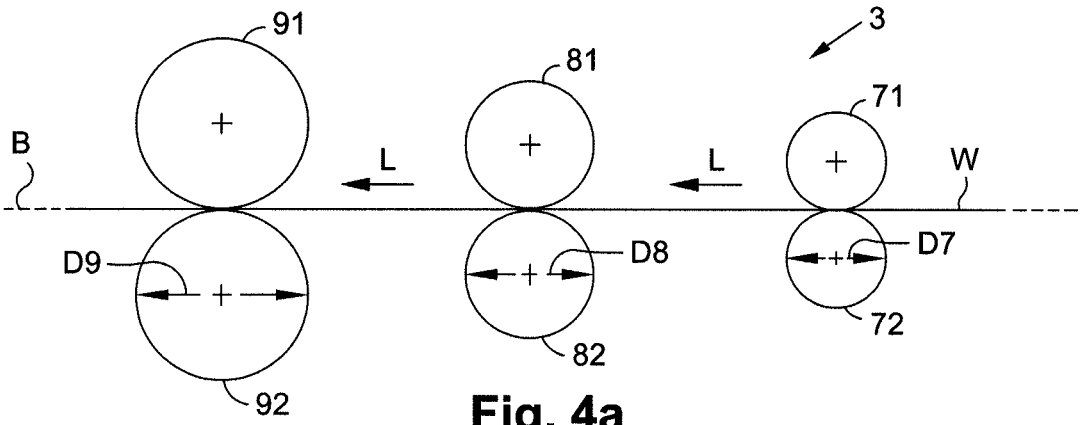
FIGS. 4*a* and 4*b* show a simplified side and top view, respectively, of the station for converting a flat substrate, illustrating the conversion method.
Figure 4B:
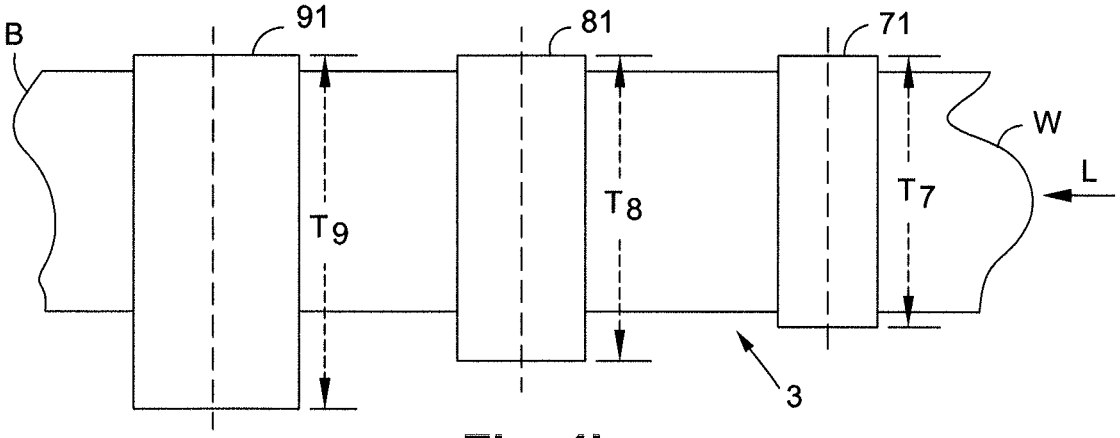

The rotary cutting unit 9 comprises an upper rotary tool 91 and a lower rotary tool 92 (see FIGS. 3, 4*a* and 4*b*). One of the two tools, for example the upper rotary tool 91, is provided with cutting threads disposed according to the cutting layout. The cutting layout has the desired repeated pattern for cutting the flat substrate. The other of the two tools, for example the lower rotary tool 92, also known as an anvil, has an entirely smooth surface.

The rotary deformation (i.e. embossing 7 or scoring 8) unit comprises (see FIG. 2) an upper rotary tool 10, which is, for example, the male tool, and a lower rotary tool 11, which is, for example, the female tool, which modify the flat substrate W by deformation (i.e. embossing and/or scoring) in order to obtain packaging. More specifically, the embossing unit 7 comprises (see FIGS. 3, 4*a* and 4*b*) an upper rotary tool 71 and a lower rotary tool 72. The scoring unit 8 comprises (see FIGS. 3, 4*a* and 4*b*) an upper rotary tool 81 and a lower rotary tool 82.

The two rotary tools 10 and 11 are mounted parallel to one another, one above the other, and extend in the transverse direction T, perpendicular to the direction of longitudinal movement L of the flat substrate W. In operation, the two rotary tools 10 and 11 rotate in opposite directions about a transverse axis of rotation (arrows Fs and Fi). The rear ends of the rotary tools 10 and 11, on the opposite side from the driver, are driven in rotation by motorized drive means. The flat substrate W passes through the gap situated between the rotary tools 10 and 11 in order to be embossed and/or scored therein.

At least one of the two rotary tools, the upper rotary tool 10 or the lower rotary tool 11, comprises a mandrel 12 and a removable sleeve 13 that is able to be fitted on and removed from the mandrel 12 in the transverse direction T (arrow G in FIG. 2). Thus, when an operator wishes to change the rotary tools 10 and 11, all that is necessary is to change the sleeves 13 rather than the entire rotary tool 10 and 11. Since it is easier to handle the sleeve 13 on account of its low weight relative to that of the entire rotary tool 10 and 11, the change of operation can be effected rapidly. Moreover, the sleeves 13 are inexpensive compared with the price of the rotary tool 10 and 11 as a whole. It is thus advantageous to use one and the same mandrel 12 in combination with several sleeves 13 rather than to acquire several entire rotary tools 10 and 11.

The sleeve 13 has a hollow and cylindrical overall shape. It is made, for example, of aluminum material. The sleeve for each of the tools 71, 72, 81 and 82 can have an identical or different diameter D7 and D8 and an identical or different length T7 and T8 (FIGS. 4*a* and 4*b*).

The mandrel 12 has a cylindrical central body, a front journal and a rear journal, forming a rotating shaft of the rotary tool. The front and rear journals are held by front and rear bearings, respectively. The rear journals of the rotary tools, on the opposite side from the driver, are driven in rotation by a motor.

During embossing or scoring operations, the sleeve 13 is held firmly on the mandrel 12 in order to be driven and rotated about the transverse axis of rotation. Several embodiments can be employed to firmly fix the sleeve 13 reversibly to the mandrel 12.

According to a first embodiment, the rotary tool comprises a first, removable, end piece situated at the front. The front end piece forms the front journal. This front end piece is coaxial and frustoconical, thus having an inclined rear face complementary to an inclined front face of the sleeve 13. The front end piece is screwed onto the central body of the mandrel 12.

The rotary tool comprises a second end piece situated at the rear. The rear end piece forms the rear journal. This rear end piece is coaxial and frustoconical, thus having an inclined front face complementary to an inclined rear face of the sleeve 13. The rear end piece is secured to the central body of the mandrel 12. The clamping of the front end piece pushes the sleeve 13 against the rear end piece to lock the sleeve 13 on the mandrel 12.

According to another embodiment, the rotary tool comprises a duct for feeding a pressurized fluid such as compressed air or oil. The duct passes through the rear journal in order to convey a pressurized fluid through the pierced central body. When a pressurized fluid is injected into the feed duct, it passes through the central body and pushes the sleeve 13 away from the mandrel 12, making it easier to fit or remove the sleeve 13.

According to a third exemplary embodiment, the central body of the mandrel 12 comprises a pressure chamber closed by an outer peripheral wall that is radially movable with respect to the transverse axis of rotation of the mandrel 12. Thus, when the pressure chamber is pressurized, the outer peripheral wall is pressed against the inner envelope surface of the sleeve 13 in order to firmly fix the sleeve 13 to the mandrel 12. The pressure chamber can be pressurized by means of a fluid such as oil.

The mandrels 12 of the rotary tools 10 and 11 are supported by front and rear bearings that engage with the front and rear journals. The embossing unit 7 or scoring unit 8 comprises a lower front bearing and a lower rear bearing for the lower rotary tool 11 and an upper front bearing and an upper rear bearing for the upper rotary tool 10. The lower and upper front bearings are arranged in a front column 14 of the load-bearing structure and the lower and upper rear bearings in a rear column. The front column 14 and rear column are parallel and extend vertically.

The bearings of at least one or of both of the rotary tools 10 and 11 can be adjusted in terms of height. This adjustment makes it possible to keep the flat substrate W horizontal at a given height H (see FIG. 3), upstream and downstream of the rotary cutting unit 9, during the conversion of the flat substrate W by the deformation unit(s) 7 and 8. This adjustment makes it possible to keep the flat substrate W horizontal regardless of the diameter of the rotary tool 10 and 11.

Several means make it possible to offset the front column 14 carrying the front bearings, on the side of the driver, of the rotary tools 10 and 11, in order to access the sleeves 13.

According to a first example, the front column 14 is movable in the transverse direction T, for example, by sliding, such that the front bearings are disengaged from the upper and lower rotary tools 10 and 11. These front bearings can thus be moved away and therefore allow access to the mandrels 12 and sleeves 13.

According to a second example, the front column 14 is mounted so as to slide and pivot about a vertical axis. Thus, the front column 14 of the load-bearing structure can move away from the front bearings of the upper and lower rotary tools 10 and 11, allowing access to the mandrels 12 and sleeves 13.

According to a third example, the upper and lower front bearings are mounted so as to slide and pivot with respect to the front column between a position spaced apart from the rotary tools and a locking position. In the locking position, the bearings engage with the rotary tools and retain the sleeve 13. In order to change the sleeve 13, the bearings slide forward and then they pivot away from the front journals of the mandrels 12, thereby freeing the space for extracting the sleeves 13 through the front column 14 and for fitting new ones.

According to another example, the front column 14 can be removed entirely, for example, by being unscrewed.

The conversion station 3 can thus comprise, upstream of the rotary cutting unit 9, one or more embossing units 7 in series, or comprise one or more embossing units 7 in series followed by one or more scoring units 8, or one or more scoring units 8 in series. In the exemplary embodiment (FIG. 3), the conversion station 3 comprises an embossing unit 7 followed by a scoring unit 8 and a rotary cutting unit 9.

Thus, when an operator wishes to change the rotary tools 10 and 11 of the embossing 7 or scoring 8 units of the conversion machine, all that is necessary is for him to change the sleeves 13 rather than the entire rotary tool. Since it is easier to handle the sleeve 13 on account of its low weight relative to that of the entire rotary tool, the change of operation can be effected rapidly.

The sleeves 13 are inexpensive compared with the price of the rotary tool as a whole. It is thus advantageous to use one and the same mandrel 12 in combination with several sleeves 13 rather than to acquire several entire rotary tools. In order to optimize the weight and cost of the tool 10 and 11 and adapt to the format of the layout, several diameters of sleeves 13 are used on a single mandrel 12. In order to optimize the weight and cost of the sleeve 13, several diameters of mandrels 12 can be used.

Furthermore, the conversion machine comprising a unit for deforming the substrate, i.e. an embossing unit 7 and/or scoring unit 8, incorporated upstream of a rotary cutting unit 9 has great flexibility of use.

As a result, a method for converting the flat substrate W is implemented in the station 3 for converting the flat substrate W. The method comprises determining the parameters of conversion of the flat substrate W as the first step. These parameters are the desired deformation layout for the flat substrate W and the desired cutting layout for the flat substrate W. The deformation layout notably comprises the length of the repeated pattern and the width of the repeated pattern desired on the surface of the flat substrate.

The second step may be choosing the sleeve 13 carrying the form for carrying out the deformation depending on the deformation layout. The second step may be implemented by choosing one or two embossing sleeves for constituting the one or two embossing tools 71 and 72 of the embossing unit 7. The second step may be implemented by choosing a scoring sleeve for constituting the one or two scoring tools 81 and 82 of the scoring unit 8. The step of choosing the sleeve(s) 13 is implemented by choosing the diameter D7 and D8 (FIGS. 4*a* and 4*b*) of the sleeves 13, and thus the diameter of the embossing tools 71 and 72 and scoring tools 81 and 82 depending on the length of the deformation layout. The step of choosing the sleeve(s) 13 is implemented by choosing the length T7 and T8 (FIGS. 4*a* and 4*b*) of the sleeves 13, and thus the diameter of the embossing tools 71 and 72 and scoring tools 81 and 82 depending on the width of the deformation layout.

The third step may be mounting the chosen sleeve(s) 13 on the mandrel 12 in the rotary deformation unit, i.e. the embossing unit 7 and the scoring unit 8.

The fourth step may be choosing the cutting tools 91 and 92 depending on the cutting layout. The step, of choosing the cutting tools 91 and 92, is implemented by choosing the diameter D9 of the cutting tools 91 and 92 depending on the length of the cutting layout, and by choosing the length T9 of the cutting tools 91 and 92 depending on the width of the cutting layout.

The fifth step may be mounting the cutting tools 91, 92 in the rotary cutting unit 9.

The sixth step may be starting the conversion of the flat substrate W with the set of tools chosen 71, 72, 81, 82, 91 and 92.

The present invention is not limited to the embodiments described and illustrated. Numerous modifications can be made without otherwise departing from the scope defined by the set of claims.

The invention claimed is:

1. A method for converting a flat substrate in a converting station comprising a rotary cutting unit having an upper rotary cutting tool and a lower rotary cutting tool and at least one rotary deformation unit, the at least one rotary deformation unit being positioned upstream of the rotary cutting unit in a direction of movement of the flat substrate, the at least one rotary deformation unit having an upper rotary deformation tool, a lower rotary deformation tool, configured to cooperate with the upper rotary deformation tool, a first sleeve and a second sleeve, each of the first sleeve and the second sleeve configured to be positioned on one of the upper rotary deformation tool and the lower rotary deformation tool, the method comprising:

determining conversion parameters of the flat substrate, the conversion parameters including a deformation layout and a cutting layout;

choosing one of the first sleeve and the second sleeve, each of the first sleeve and the second sleeve carrying a form configured to deform the flat substrate based on the deformation layout, the first sleeve having at least one of a diameter and a length different from the second sleeve;

accessing the mandrel;

mounting the sleeve on a mandrel in the rotary deformation unit;

choosing the upper rotary cutting tool and the lower rotary cutting tool based on the cutting layout;

mounting the upper rotary cutting tool and the lower rotary cutting tool in the rotary cutting unit;

adjusting at least one height of bearings of at least one of the upper rotary deformation tool and the lower rotary deformation tool so that the flat substrate is kept horizontal upstream of the rotary cutting unit; and starting conversion of the flat substrate with the at least one rotary deformation unit and the rotary cutting unit, wherein the upper rotary cutting tool is different from the upper rotary deformation tool, and the lower rotary cutting tool is different from the lower rotary deformation tool.

2. The method according to claim 1, wherein the choosing of the sleeve comprises choosing an embossing sleeve.

3. The method according to claim 1, wherein the choosing of the sleeve comprises choosing a scoring sleeve.

4. The method according to claim 1, wherein the choosing of the sleeve comprises at least one of choosing of the sleeve with a diameter based on a length of the deformation layout and choosing the sleeve with a length based on a width of the deformation layout.

5. The method according to claim 1, wherein the choosing of the sleeve comprises choosing a length of the sleeve based on a width of the deformation layout.

6. The method according to claim 1, wherein the choosing of the upper rotary cutting tool and the lower rotary cutting tool comprises choosing a diameter of the upper rotary cutting tool and the lower rotary cutting tool based on a length of the cutting layout, and by choosing a length of the upper rotary cutting tool and the lower rotary cutting tool based on a width of the cutting layout.

7. A station configured to convert a flat substrate, the station comprising:

a rotary cutting unit including an upper rotary cutting tool and a lower rotary cutting tool; and at least one rotary deformation unit positioned upstream of the rotary cutting unit in a direction of movement of the flat substrate, and the at least one rotary deformation unit comprising:

a lower rotary deformation tool and an upper rotary deformation tool configured to cooperate with the lower rotary deformation tool, wherein at least one of the lower and upper rotary deformation tools comprises a mandrel and a first sleeve and a second sleeve having at least one of a diameter and a length different from the first sleeve, each sleeve carrying a form configured for carrying out the deformation and each sleeve configured to fit on the mandrel in order to be driven and rotated by the mandrel, wherein at least one height of bearings of at least one of the upper rotary deformation tool and the lower rotary deformation tool is adjustable so that the flat substrate is kept horizontal upstream of the rotary cutting unit, and wherein the upper rotary cutting tool is different from the upper rotary deformation tool and the lower rotary cutting tool is different from the lower rotary deformation tool.

8. The station according to claim 7, wherein the deformation unit is an embossing unit, and each of the first sleeve and the second sleeve carries a form configured for embossing.

9. The station according to claim 7, wherein the deformation unit is a scoring unit, and each of the first sleeve and the second sleeve carries a form configured for scoring.

* * * * *